US011217956B2

(12) United States Patent
Frolic

(10) Patent No.: US 11,217,956 B2
(45) Date of Patent: Jan. 4, 2022

(54) ELECTRICAL PLUG REMOVAL IMPLEMENT

(71) Applicant: Nate Frolic, Rock Springs, WY (US)

(72) Inventor: Nate Frolic, Rock Springs, WY (US)

( * ) Notice: Subject to any disclaimer, the term of this patent is extended or adjusted under 35 U.S.C. 154(b) by 0 days.

(21) Appl. No.: 16/839,008

(22) Filed: Apr. 2, 2020

(65) Prior Publication Data

US 2021/0313755 A1 Oct. 7, 2021

(51) Int. Cl.
*H01R 43/22* (2006.01)

(52) U.S. Cl.
CPC ..... *H01R 43/22* (2013.01)

(58) Field of Classification Search
CPC ..... H01R 43/22
See application file for complete search history.

(56) References Cited

U.S. PATENT DOCUMENTS 3,160,947 A * 12/1964 Sunderlin ..... H01R 13/6335 29/764
4,210,377 A * 7/1980 La Voque ..... H01R 13/6335 439/484
5,102,355 A * 4/1992 Murphy ..... H01R 25/006 439/536
5,516,305 A * 5/1996 Haluska ..... H01R 13/6335 439/476.1
D404,984 S * 2/1999 Skinner ..... D8/14
2009/0042425 A1* 2/2009 Boerner ..... H01R 13/6335 439/160
2013/0109205 A1* 5/2013 Oddsen ..... H01R 25/006 439/106
2015/0056831 A1* 2/2015 Llewellyn, III ... H01R 13/6335 439/152

* cited by examiner

*Primary Examiner* — Peter Dungba Vo
*Assistant Examiner* — Jose K Abraham
(74) *Attorney, Agent, or Firm* — Steven Rinehart

(57) ABSTRACT

An electrical plug removal tool/implement comprising a nonconductive faceplate having a set of apertures contoured to receive the prongs of an electrical plug. The removal implement positions between the electrical outlet and the electrical plug, with the prongs traversing the same, and is adapted to pull the plug from the outlet when flexible strings are pulled which are affixed to the faceplate. The faceplate may comprise a plurality of sets of apertures in some embodiments.

15 Claims, 9 Drawing Sheets

ELECTRICAL PLUG REMOVAL IMPLEMENT

BACKGROUND OF THE INVENTION

Field of the Invention

This invention relates to electrical apparati, and more particularly relates to an implement facilitated to remove electrical plugs from electrical sockets.

Description of the Related Art

It can be difficult in many situations for lay persons to easily remove electrical plugs from electrical sockets without damaging the electrical plug and putting themselves at risk of injury or worse from electrocution.

Because electrical outlets typically position near a floor surface, the electrical plugs cannot readily be drawn horizontally from the electrical outlet. Because it is difficult for a user to stoop as low as the electrical outlet itself, plugs tend to be pulled upwards instead of outwards, bending the prongs over time. Quite often, users pull the plug using the chord affixed to the plug, damaging the plug over time and pulling the conductive wires away from the plug. Furthermore, some users wiggle the plug to-and-fro, inching the plug bit-by-bit from the outlet, while in so doing exposing themselves to risk of electrocution should the user's fingers come in contract with the plugs still in contact with the outlet.

There exists so effective means in the art of easily and efficiently removing the plug from the outlet with risk of exposure to electrocution nor risking damage to the plug. There exists a need in the art for a more efficient embodiment which provides interchangeability with multiple plugs and which does not interfere with the plane in which the plug and chord orient. It is an object of the present invention to provide such a removal implement.

SUMMARY OF THE INVENTION

From the foregoing discussion, it should be apparent that a need exists for a mechanism for facilitating removal of an electrical plug from an electrical socket without risking bending the prongs of the plug nor exposing a user to inadvertent electrocution. Beneficially, such an apparatus would overcome many of the difficulties and safety concerns expressed.

The present invention has been developed in response to the problems and needs in the art that have not yet been fully solved by currently available apparati and methods. Accordingly, the present invention has been developed to provide an electrical plug removal implement comprising: a faceplate fabricated from a nonconductive polymeric material; a cluster of apertures comprising three or more apertures traversing the faceplate, each aperture shaped to contour a prong of standard-sized electrical plug and allow through-passage of said prong; one or more flexible strings affixed at a proximal end to the faceplate adapted to pull away the faceplate from an abutting electrical outlet; wherein the faceplate is adapted to position between an electrical outlet and a body of an electrical plug with the prongs of the electrical plug passing through the faceplate.

The faceplate may be fabricated from one of a flexible and rigid material. The faceplate may be shaped as one of round, square, triangular, and hexagonal.

The cluster of apertures may comprise apertures shaped to contour the prongs of a 15-amp 110V electrical outlet.

In some embodiments, the cluster of apertures comprises apertures shaped to contour one of the prongs of: a 20-amp 110V electrical outlet, a 30-amp 110V electrical outlet, and a 50-amp 250V electrical outlet.

A forward tensile force applied to the flexible strings may pull the faceplate and electrical plug out of the electrical outlet.

The flexible string may comprise a nonconductive flexible chord fabricated from woven twine or rope. The electrical plug removal implement may further comprise a plurality of flexible strings, each affixed at a proximal end to the faceplate and tied together at a distal end.

The electrical plug removal implement may also further comprise two or more sets of apertures superimposed over on another on the faceplate.

The electrical plug removal implement, in some embodiments, further comprises four or more sets of apertures arranged at evenly-spaced intervals around a perimeter of the faceplate.

The electrical plug removal implement further comprises, in some embodiments, a centrally-disposed cluster of apertures.

The electrical plug removal implement may also further comprise two tabs laterally-protruding from the faceplate.

A second electrical plug removal implement is provided comprising: a faceplate fabricated from a nonconductive polymeric material; one or more clusters of apertures comprising three or more apertures traversing the faceplate, each aperture shaped to contour a prong of standard-sized electrical plug and allow through-passage of said prong; two tabs protruding laterally from the faceplate, each tab defining an aperture; one or more flexible strings affixed at a proximal end to a tab, the flexible strings adapted to pull away the faceplate from an abutting electrical outlet; wherein the faceplate is adapted to position between an electrical outlet and a body of an electrical plug with the prongs of the electrical plug passing through the faceplate.

The electrical plug removal implement may further comprise a plurality of clusters of apertures. One or more of the clusters of apertures may be superimposed over a first cluster of apertures. Two or more of the clusters of apertures may be superimposed over a first cluster of apertures.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
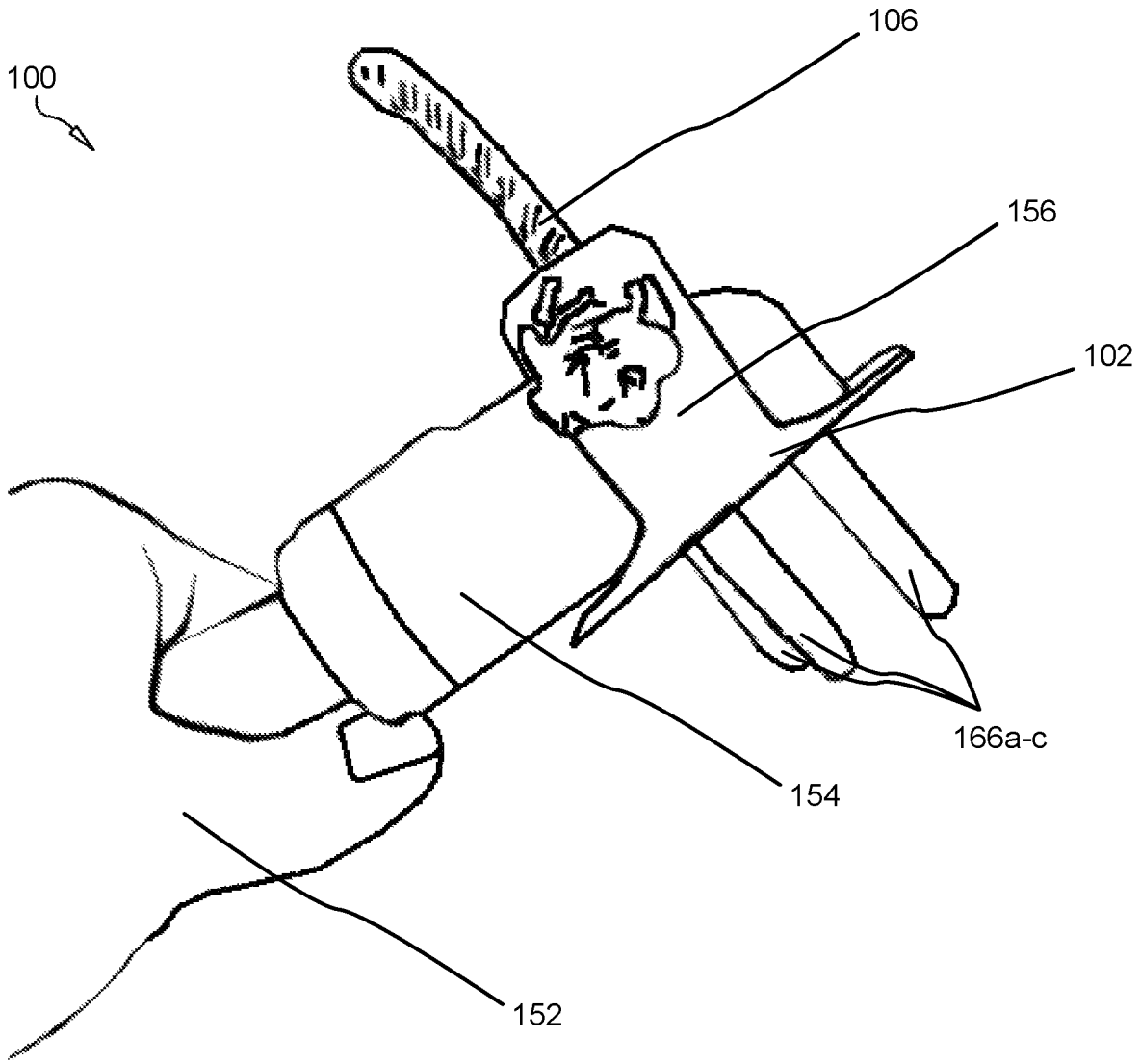
FIG. 1 is an environmental, side perspective view of an electrical plug removal implement in accordance with the present invention.

FIG. 1 is an environmental, side perspective view of an electrical plug removal implement 100 in accordance with the present invention.

The implement 100 is mounted on an electrical plug 154 being gripped by a user's hand 152. The electrical plug 154 comprises a plurality of prongs 166 which protrude laterally from the plug 154 and cantilever therefrom. The implement 100 comprises a faceplate 102 formed from a rigid, flexible or semi-flexible, nonconductive, polymeric material. The faceplate 102 comprises a planar forward surface and a planar rearward surface. A plurality of apertures position on the faceplate through which the prongs 166 protrude.

In various embodiments, the faceplate 102 comprises two lateral tabs 156 (or wings) which protrude laterally from the faceplate 102. These tabs 156 may also define bores or apertures through which a chord 106 is tied. The chord 106 may alternatively be twine, rope, cable or the like.

Figure 2:
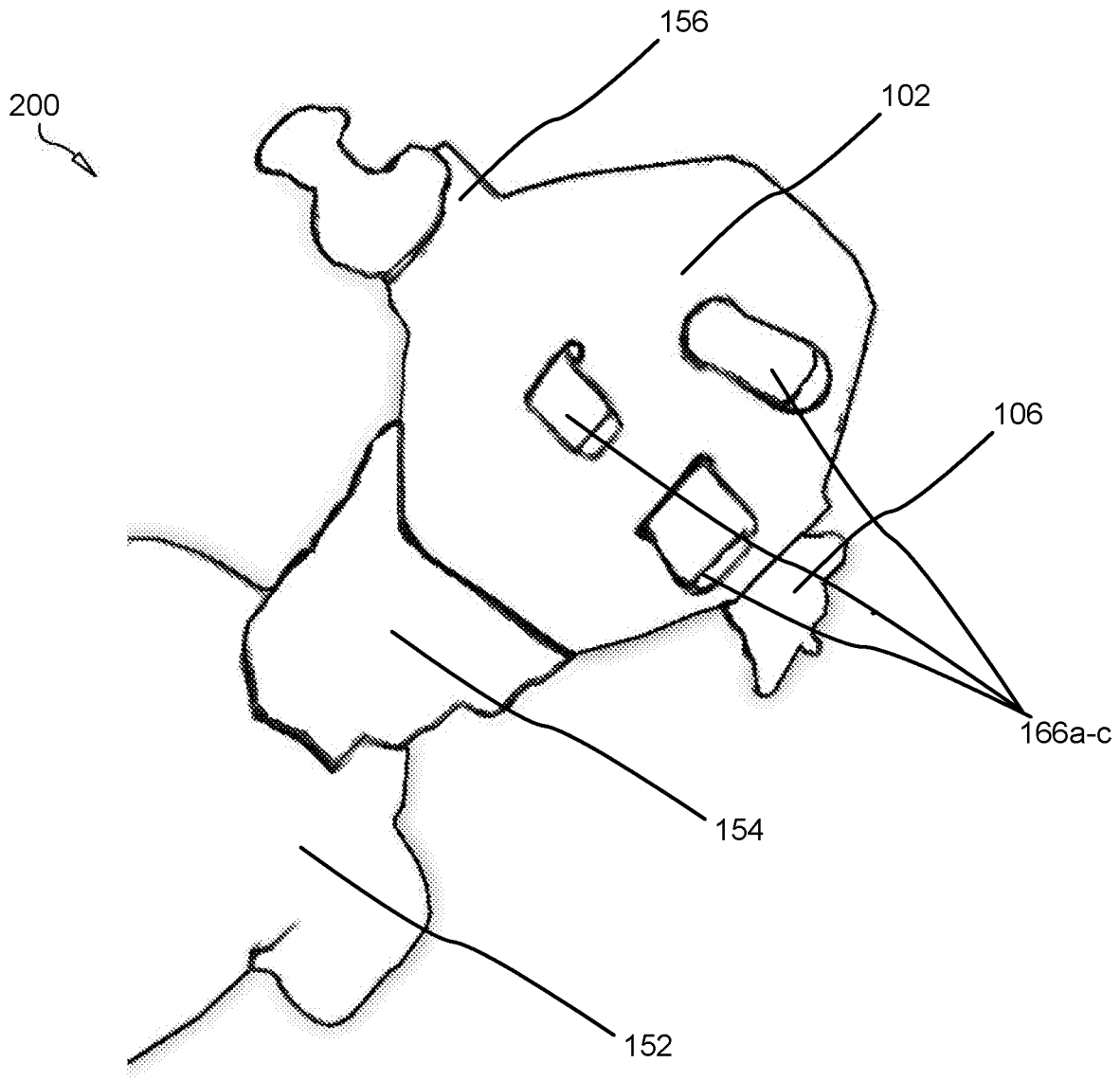
FIG. 2 is an environmental, forward perspective view of an electrical plug removal implement in accordance with the present invention.

FIG. 2 is an environmental, forward perspective view of an electrical plug removal implement 200 in accordance with the present invention.

The faceplate 102 is adapted to position between the plug 154 and a socket on a wall surface. The chord 106 may be drawn rearwardly to pull the plug 154 from the socket without damaging the socket nor the plug 154. Because the chord 106 is flexible, while the chord affixed to the plug 154 is typically not, a user is able to pull the plug 154 from the wall along a line which is roughly perpendicular to the wall surface. Other variations in the art do not comprise this flexible chord, which does not interfere with chord to which the plug 154 is affixed. Other variations in the art do not comprise a chord 106 which is flexible along all axes.

Figure 3:
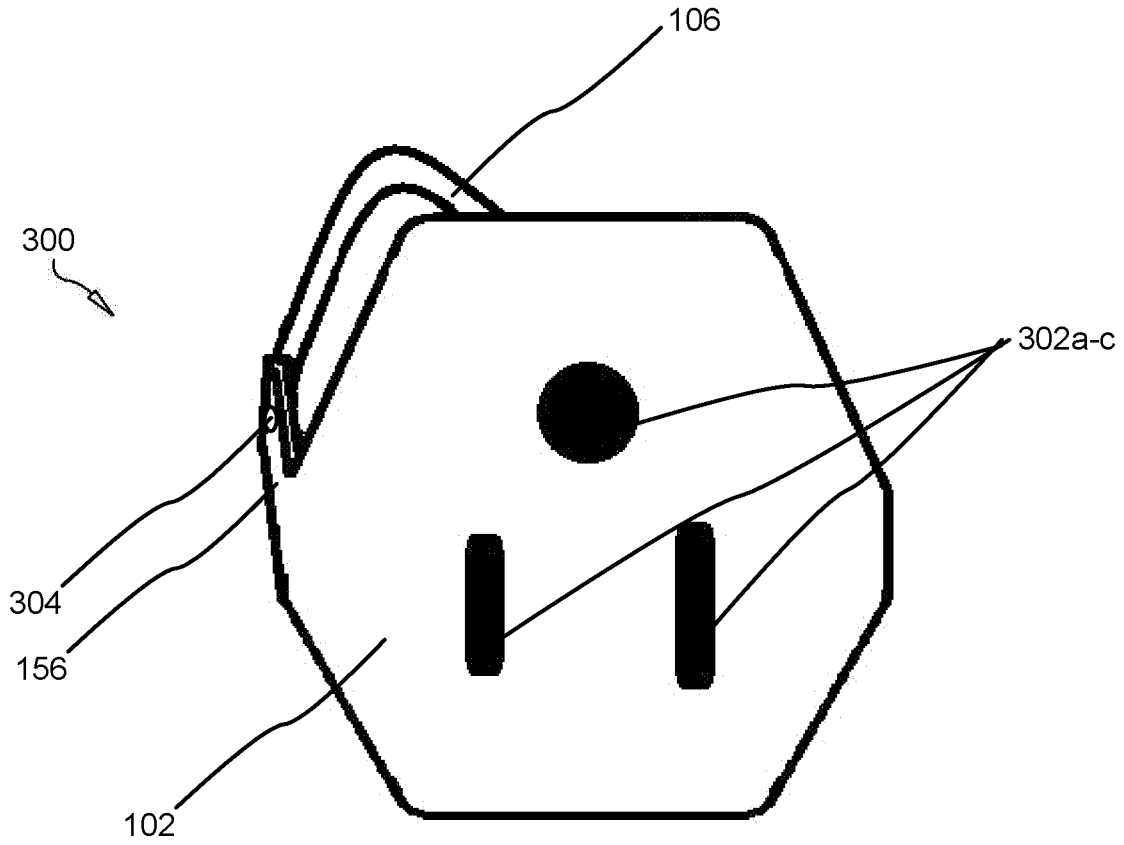
FIG. 3 is a forward perspective view of an electrical plug removal implement in accordance with the present invention.

FIG. 3 is a forward perspective view of an electrical plug removal implement 300 in accordance with the present invention.

The tab 156 defines an aperture 304 through which the chord 106 may be tied. The tab 156 wraps around to jut rearwardly from the faceplate 102. The tabs 156 and faceplate 102 may be formed as a single-integrated piece.

The faceplate 102 in the shown embodiment is polygonal in shape, or octagonal, from a forward perspective. The faceplate may be irregularly-shaped to contour edging on a plug 154.

Figure 4:
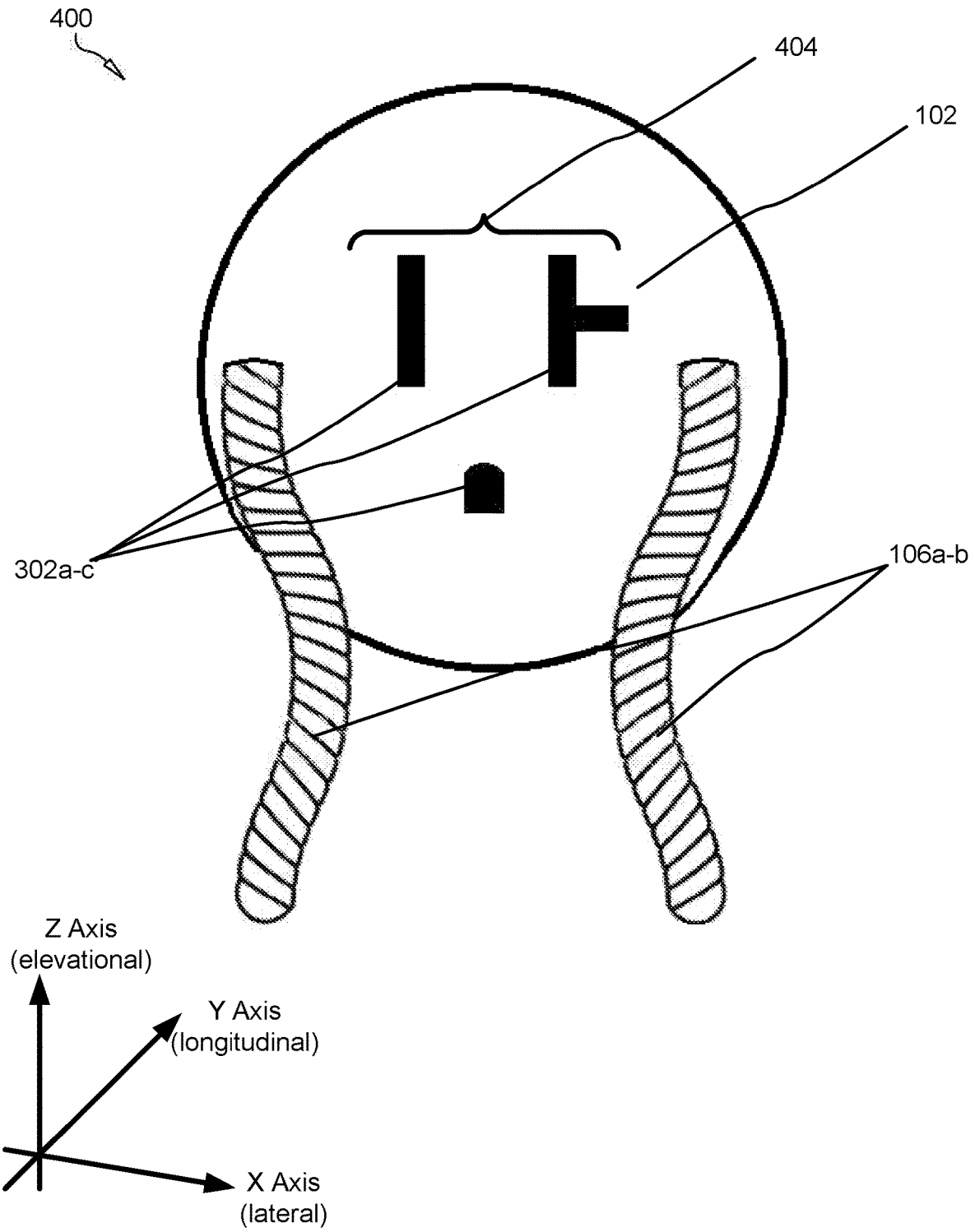
FIG. 4 is a forward perspective view of an electrical plug removal implement in accordance with the present invention.

FIG. 4 is a forward perspective view of an electrical plug removal implement 400 in accordance with the present invention.

The faceplate 102 may be circular from a forward perspective. In the shown embodiment, two chords 106 are affixed directly to the faceplate 102 instead of to tabs 156 protruding from the side of the faceplate 102.

The faceplate 102 comprises a cluster 404 of apertures 302 through the prongs 166 of the plug 154 protrude. These apertures 302 are shaped to contour the exterior surfacing of the prongs 166. For instance, aperture 302*a* comprises an elongated vertical bore in the shape of a rectangle. Aperture 302*c* may comprise a circle or half-circle combined with a square or rectangle for receiving the ground prong 166.

Figure 5:
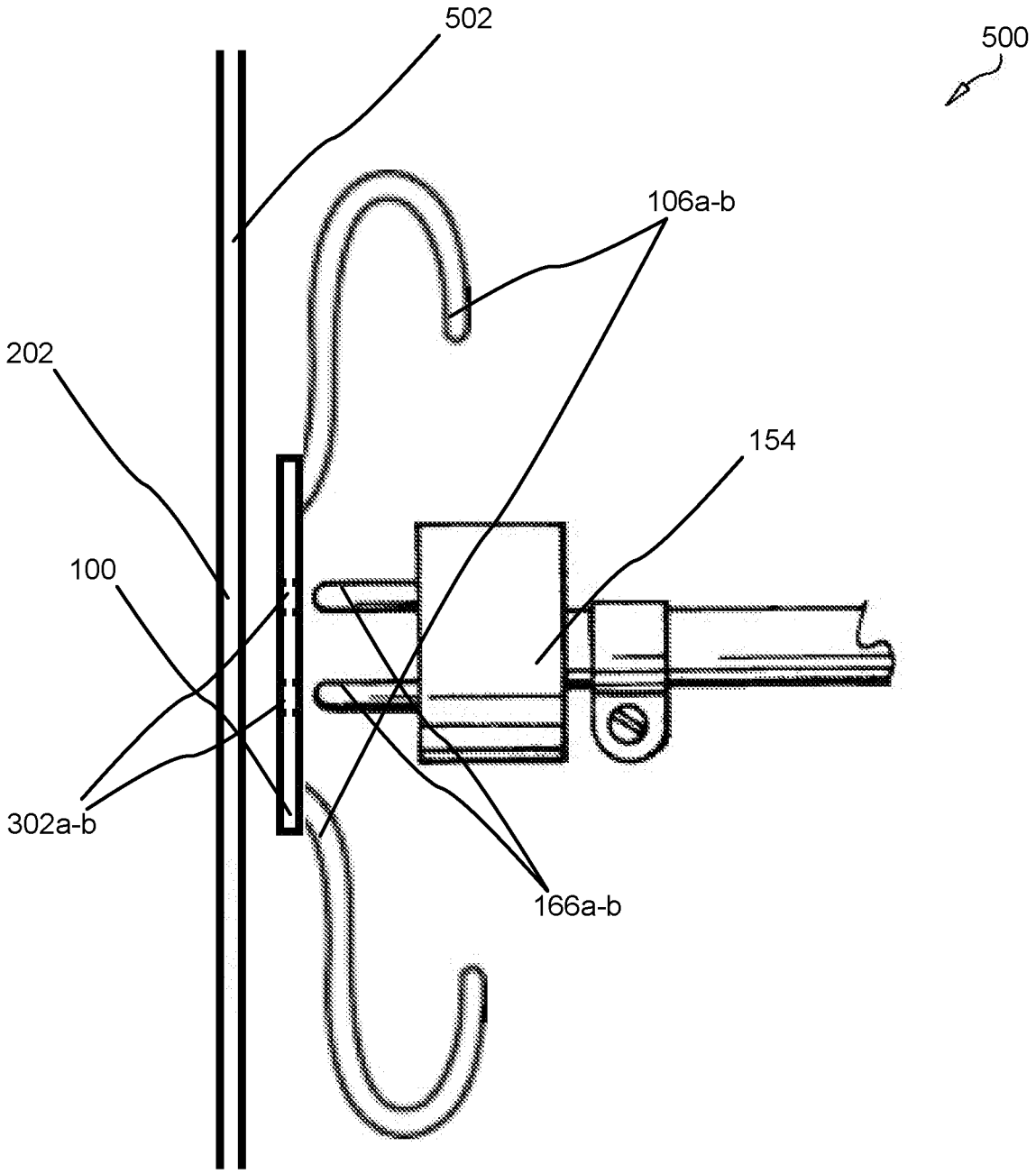
FIG. 5 is an environmental, side perspective view of an electrical plug removal implement in accordance with the present invention.

FIG. 5 is an environmental, side perspective view of an electrical plug removal implement 500 in accordance with the present invention.

As shown, the faceplate 102 positions between the plug 154 and the wall 502. The prongs 166 traverse the faceplate 102 through the apertures 302.

Figure 6:
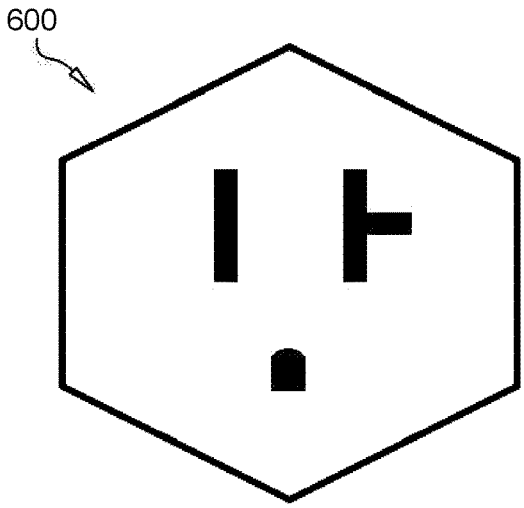
FIG. 6 is a forward perspective view of an electrical plug removal implement in accordance with the present invention.
Figure 7:
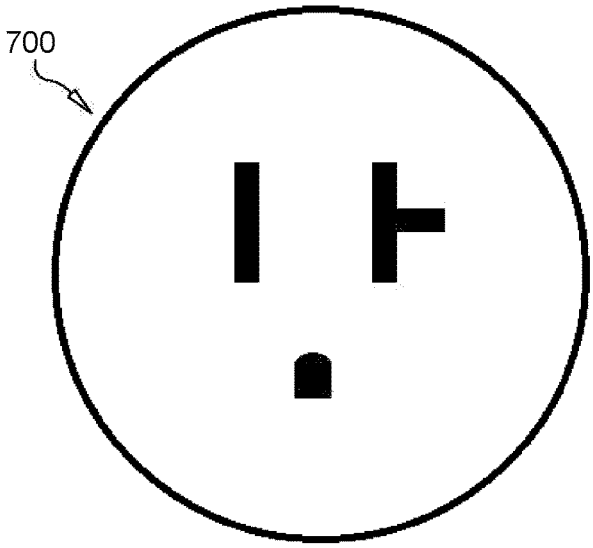
FIG. 7 is a forward perspective view of an electrical plug removal implement in accordance with the present invention.

FIGS. 6-7 illustrate forward perspective views of electrical plug removal implements 600, 700 in accordance with the present invention.

In various embodiments, the faceplate 102 is hexagonal in shape.

Figure 8:
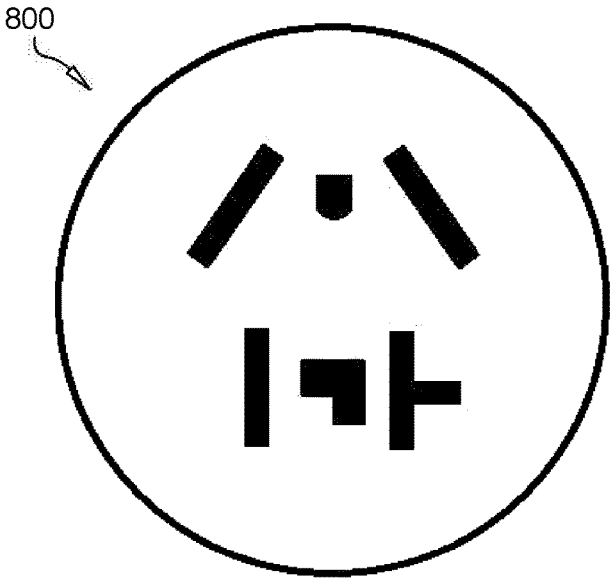
FIG. 8 is a forward perspective view of an electrical plug removal implement in accordance with the present invention.

FIG. 8 is a forward perspective view of an electrical plug removal implement 800 in accordance with the present invention.

Implement 800 comprises two clusters of apertures 404 superimposed over on another, including a 110/120 volt 15 amp cluster and a 120 volt 30 amp cluster positioned in diametrically-opposed orientations such that the implement 800 may be used interchangeably with either of two separate plugs 154.

Figure 9:
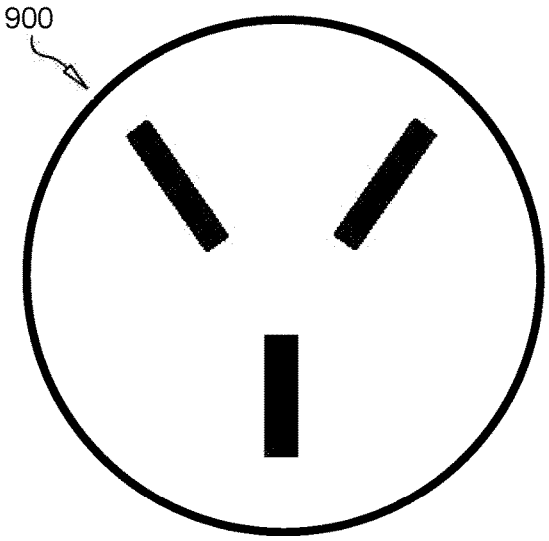
FIG. 9 is a forward perspective view of an electrical plug removal implement in accordance with the present invention.
Figure 10:
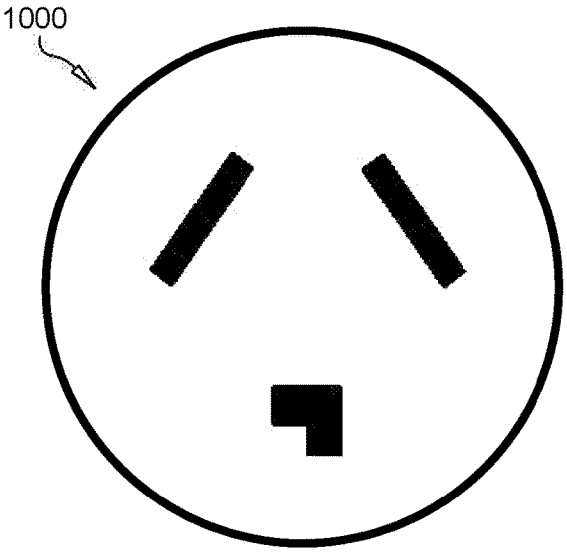
FIG. 10 is a forward perspective view of an electrical plug removal implement in accordance with the present invention.
Figure 11:
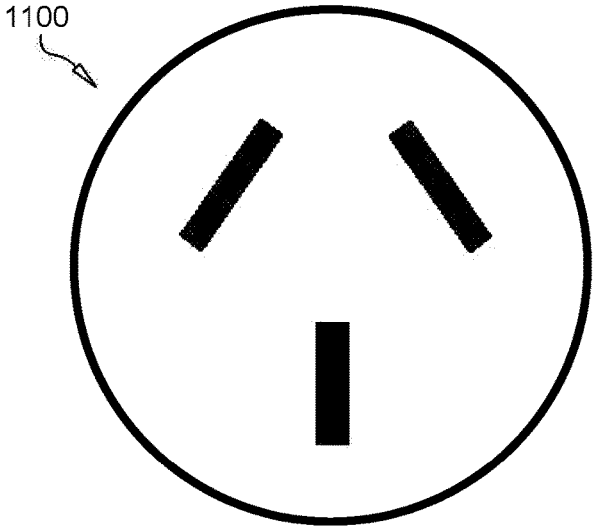
FIG. 11 is a forward perspective view of an electrical plug removal implement in accordance with the present invention.

FIGS. 9-11 illustrate forward perspective views of electrical plug removal implements 900, 1000, 1100 in accordance with the present invention.

Each of the implements 900-1100 comprise different clusters of apertures 404 adapted to interchange with different sets of plugs 166 on different plugs 154.

Figure 12:
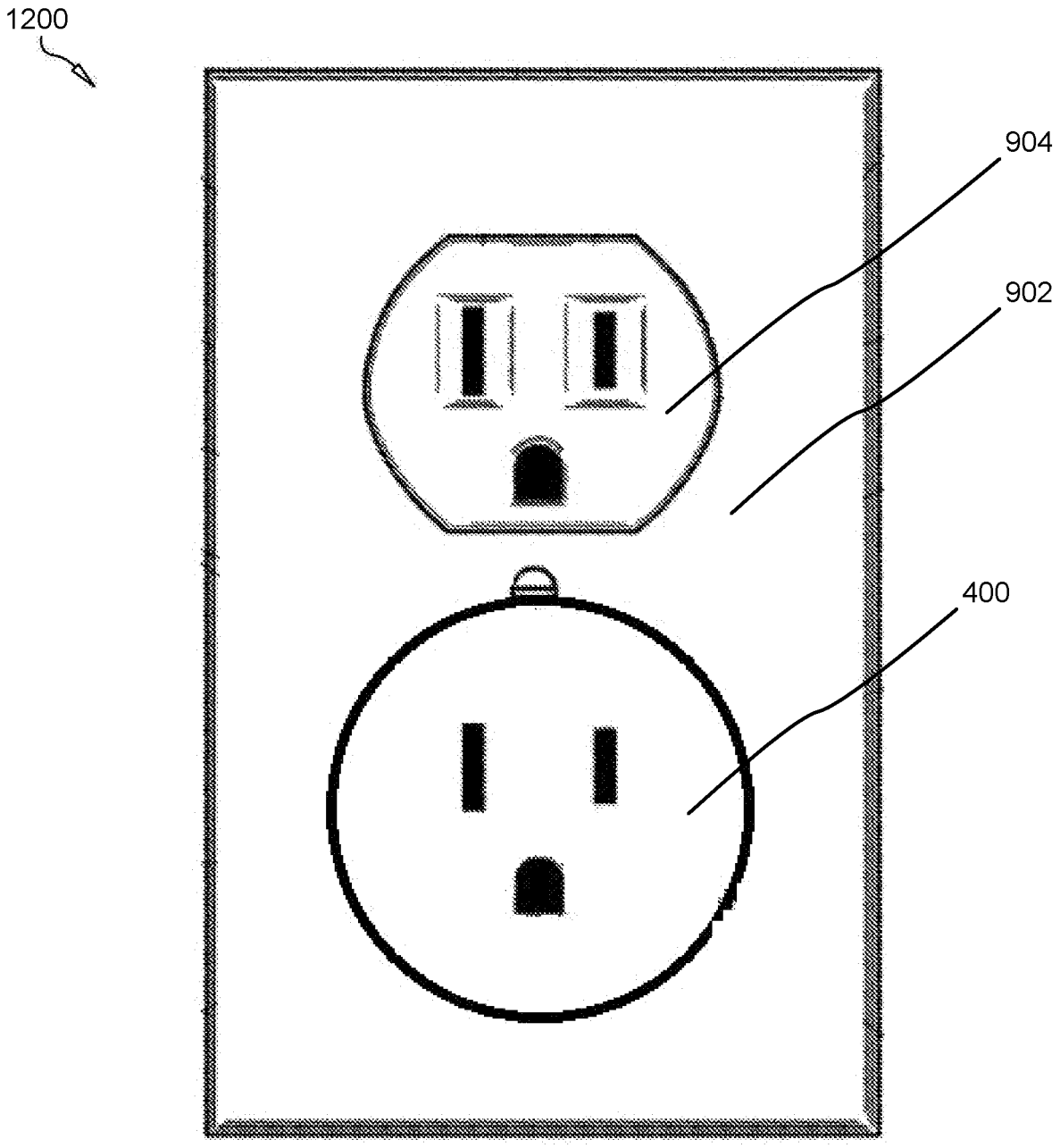
FIG. 12 is an environmental, forward perspective view of an electrical plug removal implement in accordance with the present invention.

FIG. 12 is an environmental, forward perspective view of an electrical plug removal implement 1200 in accordance with the present invention.

The faceplate 102 of the implement 1200 is shown in place over a socket.

Figure 13:
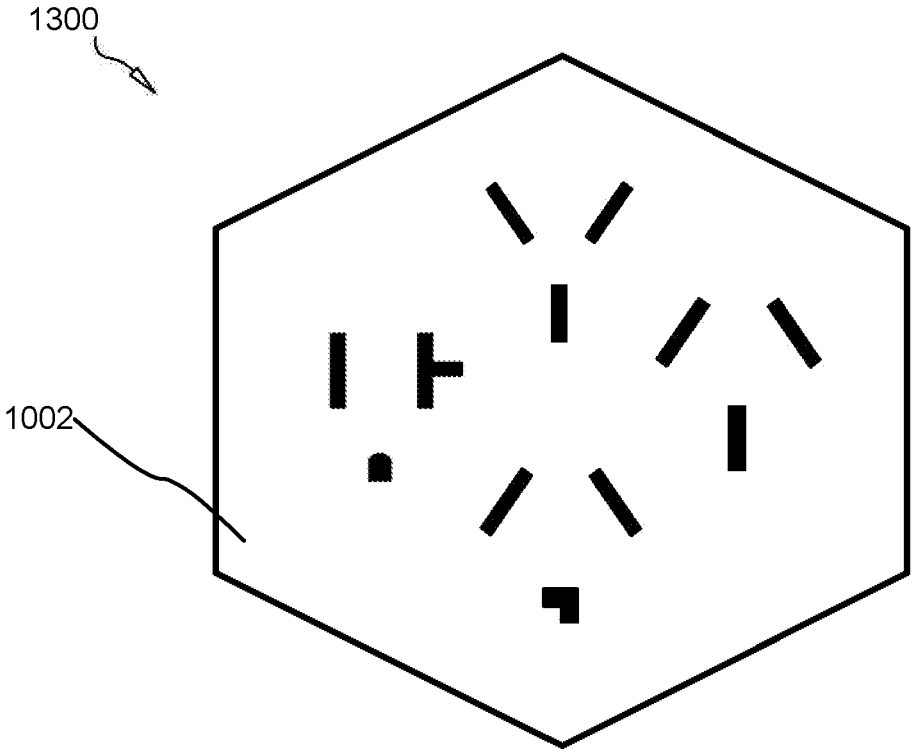
FIG. 13 is a forward perspective view of an electrical plug removal implement in accordance with the present invention.
Figure 14:
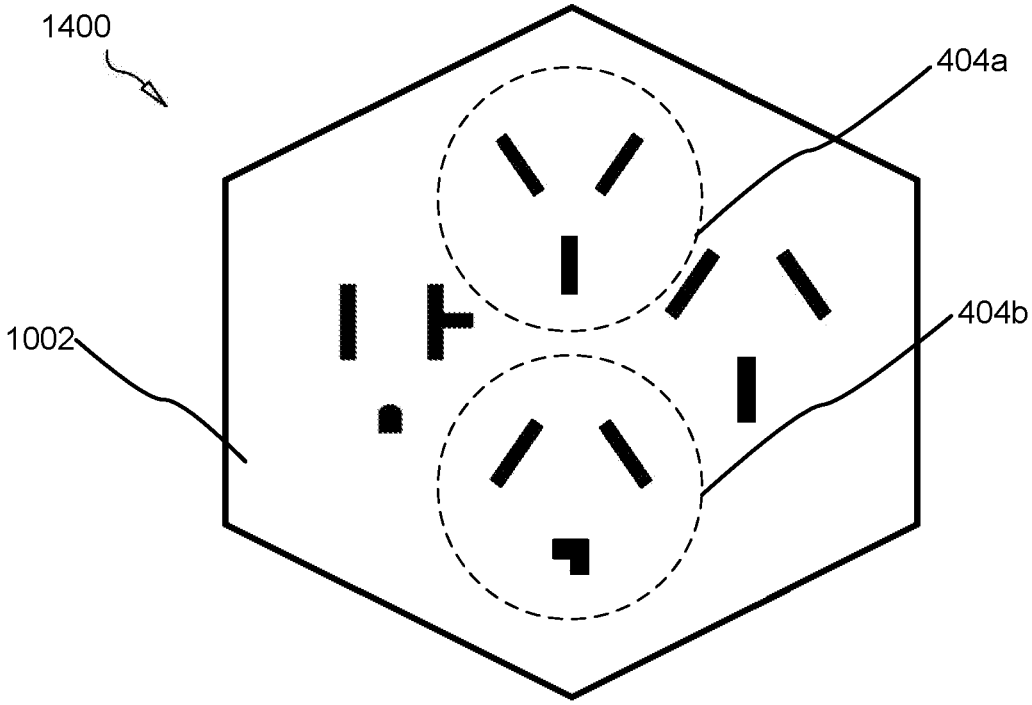
FIG. 14 is a forward perspective view of an electrical plug removal implement in accordance with the present invention.

FIGS. 13 and 14 illustrate a forward perspective view of electrical plug removal implements 1300, 1400 in accordance with the present invention.

In this variation, the implements comprise a plurality of clusters of apertures 404, each cluster adapted to interchange with a different set of prongs 166 on a plug 154.

In is an object of the present invention to provide a implement designed to facilitate removal of an electrical plug from an electrical wall socket without bending the prongs on the plug or exposing the user to inadvertent electrocution.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An electrical plug removal implement comprising:

a faceplate fabricated from a nonconductive polymeric material;

a cluster of apertures comprising three or more apertures traversing the faceplate, each aperture shaped to contour a prong of standard-sized electrical plug and allow through-passage of said prong;

one or more flexible strings affixed at a proximal end to the faceplate adapted to pull away the faceplate from an abutting electrical outlet;

two centrally-disposed different clusters of apertures superimposed over one another including a first centrally-disposed cluster and a second centrally-disposed cluster, wherein the first centrally-disposed cluster of apertures comprises apertures shaped to contour prongs of a 110 volt, 15 amperage electrical outlet, and wherein the second centrally-disposed cluster of apertures comprises apertures adapted to contour prongs of a 120 volt, 30 amperage outlet;

wherein the faceplate is adapted to position between an electrical outlet and a body of an electrical plug with the prongs of the electrical plug passing through the faceplate.

2. The electrical plug removal implement of claim 1, wherein the faceplate is fabricated from one of a flexible and rigid material.

3. The electrical plug removal implement of claim 1, wherein the faceplate comprises shapes of one of round, square, triangular, and hexagonal.

4. The electrical plug removal implement of claim 1, wherein the cluster of apertures comprises apertures shaped to contour one of the prongs of: a 20-amp 110V electrical outlet, a 30-amp 110V electrical outlet, and a 50-amp 250V electrical outlet.

5. The electrical plug removal implement of claim 1, wherein forward tensile force applied to the flexible strings pulls the faceplate and electrical plug out of the electrical outlet.

6. The electrical plug removal implement of claim 1, wherein the flexible string comprises a nonconductive flexible chord fabricated from woven twine or rope.

7. The electrical plug removal implement of claim 1, further comprising a plurality of flexible strings, each affixed at a proximal end to the faceplate and tied together at a distal end.

8. The electrical plug removal implement of claim 1, further comprising one or more sets of apertures superimposed over on another on the faceplate.

9. The electrical plug removal implement of claim 1, further comprising four or more sets of apertures arranged at evenly-spaced intervals around a perimeter of the faceplate.

10. The electrical plug removal implement of claim 9, wherein the first cluster of apertures is in diametric opposition on the faceplate to the second cluster of apertures.

11. The electrical plug removal implement of claim 1, further comprising two tabs laterally-protruding from the faceplate, where each tab juts rearwardly from the faceplate.

12. An electrical plug removal implement comprising:

a hexagonal faceplate fabricated from a nonconductive polymeric material;

three or more different clusters of apertures arranged around a center point of the faceplate, each cluster of apertures comprising three or more apertures traversing the faceplate, each cluster of apertures shaped to contour prongs of a standard-sized electrical plug and allow through-passage of said prongs;

two tabs protruding laterally from the faceplate and jutting rearwardly, each tab defining an aperture;

one or more flexible strings affixed at a proximal end to a tab, the flexible strings adapted to pull away the faceplate from an abutting electrical outlet;

wherein the faceplate is adapted to position between an electrical outlet and a body of an electrical plug with the prongs of the electrical plug passing through the faceplate.

13. The electrical plug removal implement of claim 12, further comprising a plurality of different clusters of apertures.

14. The electrical plug removal implement of claim 13, wherein two or more of the different clusters of apertures are is superimposed over a first cluster of apertures.

15. The electrical plug removal implement of claim 13, wherein one or more of the different clusters of apertures are superimposed over a first cluster of apertures.

* * * * *